US008242866B2

(12) United States Patent
Eum

(10) Patent No.: US 8,242,866 B2
(45) Date of Patent: Aug. 14, 2012

(54) SEALED CASED MAGNETIC SWITCH

(75) Inventor: Young Hwan Eum, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 64 days.

(21) Appl. No.: 12/829,435

(22) Filed: Jul. 2, 2010

(65) Prior Publication Data

US 2011/0156845 A1 Jun. 30, 2011

(30) Foreign Application Priority Data

Dec. 31, 2009 (KR) ..... 10-2009-0136230

(51) Int. Cl.
*H01H 67/02* (2006.01)
*H01F 7/08* (2006.01)

(52) U.S. Cl. ..... 335/131; 335/127; 335/274

(58) Field of Classification Search ..... 335/126, 335/127, 131–133, 274; 290/38 R–38 E, 290/48

See application file for complete search history.

(56) References Cited

U.S. PATENT DOCUMENTS

| | | | | |
|---|---|---|---|---|
| 5,801,607 | A | 9/1998 | Duverger | |
| 6,923,152 | B2 * | 8/2005 | Nagai et al. | 123/179.25 |
| 2008/0007373 | A1 | 1/2008 | Andoh et al. | |
| 2010/0133080 | A1 | 6/2010 | Jeong et al. | |

FOREIGN PATENT DOCUMENTS

| | | |
|---|---|---|
| EP | 0768695 | 4/1997 |
| JP | 11-182390 | 7/1999 |
| JP | 2001-043788 | 2/2001 |
| JP | 2007-287526 | 11/2007 |
| JP | 2007-294264 | 11/2007 |

OTHER PUBLICATIONS

Search report from E.P.O., mail date is Apr. 11, 2011.
Korea Office action, mail date is Apr. 27, 2011.
Japan Office action, mail date is May 29, 2012.

* cited by examiner

*Primary Examiner* — Ramon Barrera

(74) *Attorney, Agent, or Firm* — Greenblum & Bernstein P.L.C.

(57) ABSTRACT

A sealed cased magnetic switch includes: a first contact pressure spring having one end supported by the movable contactor and applying an elastic force to the movable contactor to provide a contact pressure in a direction in which the movable contactor is brought into contact with the fixed electrode; a spring seat member supporting the other end of the first contact pressure spring and fixedly installed on the driving shaft; and a second contact pressure spring having a diameter larger than that of the first contact pressure spring and applying an elastic force at an outer position in a radial direction compared with the first contact pressure spring to the movable contactor in a direction in which the movable contactor is brought into contact with the fixed electrode.

2 Claims, 2 Drawing Sheets

SEALED CASED MAGNETIC SWITCH

CROSS-REFERENCE TO A RELATED APPLICATION

Pursuant to 35 U.S.C. §119(a), this application claims the benefit of earlier filing date and right of priority to Korean Application No. 10-2009-0136230, filed on Dec. 31, 2009, the contents of which is incorporated by reference herein in its entirety.

BACKGROUND OF THE INVENTION

1. Field of the Invention

The present invention relates to a sealed cased magnetic switch and, more particularly, to a sealed cased magnetic switch capable of reducing noise of a switching operation.

2. Description of the Related Art

A magnetic switch, a device used for switch a power supply line, is a relatively low voltage electric power switch utilized for extensive purposes including an industrial purpose, a household purpose, electric vehicle purpose, and the like. The magnetic switch is configured to switch a power supply circuit by moving a movable contact connected to a movable core, to a circuit opening position where a movable contactor connected to the movable core is separated from a corresponding fixed electrode, or to a circuit closing position where the movable contactor is brought into contact with the corresponding fixed electrode, by moving the movable core by using magnetic force of a coil magnetized or demagnetized according to supply or interruption of control electric power source. If the contact of the movable contactor at the position where the movable contactor is in contact with the fixed electrode becomes poor due to an external factor such as vibration, an impact, and the like, at the circuit closing position, the contact may be fused, damaged, and the like to possibly cause a more critical electrical incident, so a contact pressure spring is employed to apply elastic force to the position at which the movable contactor is in contact with the corresponding fixed electrode.

However, in the magnetic switch, the use of the contact pressure spring having a high elastic force to obtain the operational reliability during the contact operation increases an impact when the movable contactor is brought into contact with the fixed electrode during the circuit closing operation, causing severe impact noise.

In particular, the magnetic switch used for homes or electric vehicles urgently needs to have a low-noise structure that does not generate such impact noise.

Meanwhile, the related art sealed cased magnetic switch includes one contact pressure spring installed around a driving shaft of a movable contactor, in which one end of the contact pressure spring is supported by a central portion of the movable contactor and the other end of the contact pressure spring is supported by a spring seat fixedly installed on the driving shaft. The related art sealed cased magnetic switch has a structure in which the contact pressure spring and the driving shaft providing a contract driving force are placed at the central portion of the movable contactor, while an outer portion of the movable contactor collides with the fixed electrode during a contact operation. Thus, a large impact is applied to the portion of the movable contactor which is brought into contact with the fixed electrode, and as shown in FIG. 1, as the stroke of the distance along which the movable contactor is moved during the contact operation increases, a total contact pressure has a lengthy nonlinear interval (i.e., the interval in which the total contact pressure is stationary without a variation in FIG. 1) starting from a collision. As the nonlinear interval is lengthy, more severe noise is generated. Thus, in the related art sealed cased magnetic switch, the nonlinear interval is lengthy in terms of the variation characteristics of the total contact pressure as the contact operation of the movable contactor is performed, generating severe noise.

SUMMARY OF THE INVENTION

Therefore, in order to address the above matters, the various features described herein have been conceived.

An aspect of the present invention provides a sealed cased magnetic switch capable of reducing noise generation when a movable contactor performs a contact operation by shortening a nonlinear interval in terms of variation characteristics of a total contact pressure as the contact operation of the movable contactor is performed.

According to an aspect of the present invention, there is provided a sealed cased magnetic switch, which includes a sealed container with one side opened, a fixed electrode airtightly attached to the side opposite to the opened side of the sealed container, a movable contactor movable to a position at which it is brought into contact with the fixed electrode and to a position at which it is separated from the fixed electrode, a driving shaft supporting the movable contactor and being movable along with the movable contactor, a movable core coupled with the driving shaft so as to be movable together, a fixed core installed to face the movable core, a bobbin accommodating the fixed core and the movable core in the interior of a hollow thereof, a coil wound around the bobbin, a yoke installed near the coil to form a magnetic path, and an iron plate forming the magnetic path along with the yoke and installed at an upper portion of the bobbin, including: a first contact pressure spring having one end supported by the movable contactor and applying an elastic force to the movable contactor to provide a contact pressure in a direction in which the movable contactor is brought into contact with the fixed electrode; a spring seat member supporting the other end of the first contact pressure spring and fixedly installed on the driving shaft; and a second contact pressure spring having a diameter larger than that of the first contact pressure spring and applying an elastic force at an outer position in a radial direction compared with the first contact pressure spring to the movable contactor is in a direction in which the movable contactor is brought into contact with the fixed electrode.

The foregoing and other objects, features, aspects and advantages of the present invention will become more apparent from the following detailed description of the present invention when taken in conjunction with the accompanying drawings.

DETAILED DESCRIPTION OF THE INVENTION

The foregoing and other objects, features, aspects and advantages of the present invention will become more apparent from the following detailed description of the present invention when taken in conjunction with the is accompanying drawings.

A sealed cased magnetic switch according to a preferred embodiment of the present invention will now be described with reference to FIGS. 2 and 3.

Figure 1:
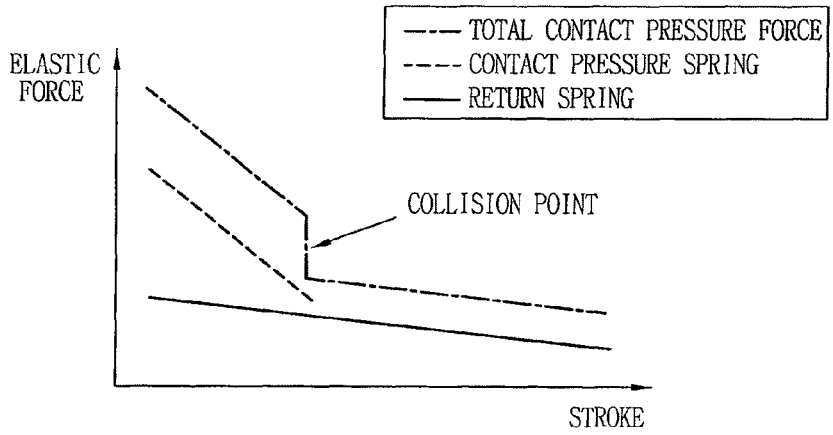
FIG. 1 RELATED ART
FIG. 1 is a graph showing a change in an elastic force over a contact position moving stroke of a movable contactor in the related art sealed cased magnetic switch, specifically, showing a change in an elastic force and a total contact pressure of a return spring and a contact pressure spring.
Figure 2:
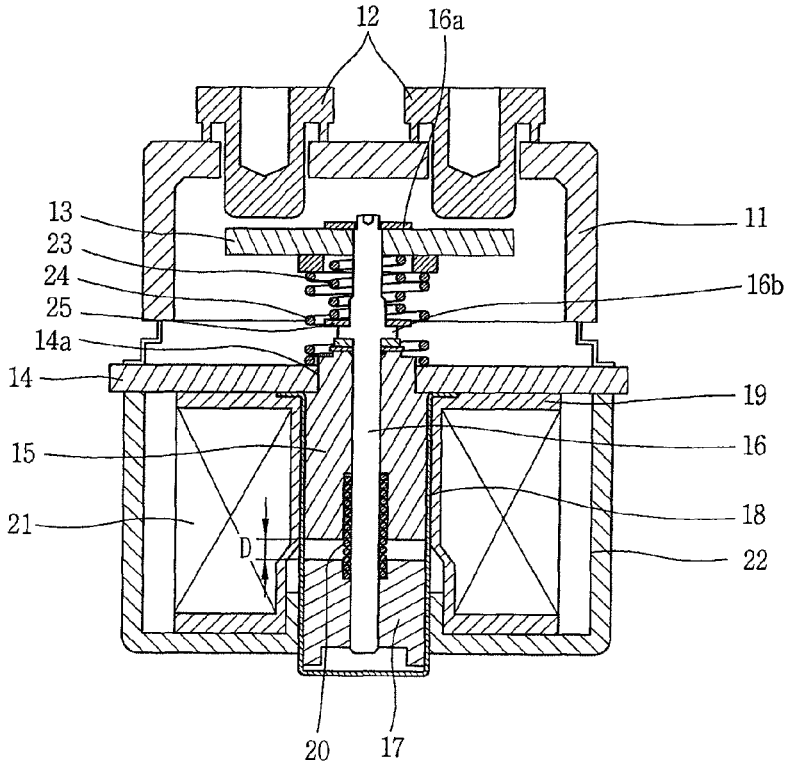
FIG. 2 is a vertical sectional view showing the configuration of a sealed cased magnetic switch according to a preferred embodiment of the present invention.
Figure 3:
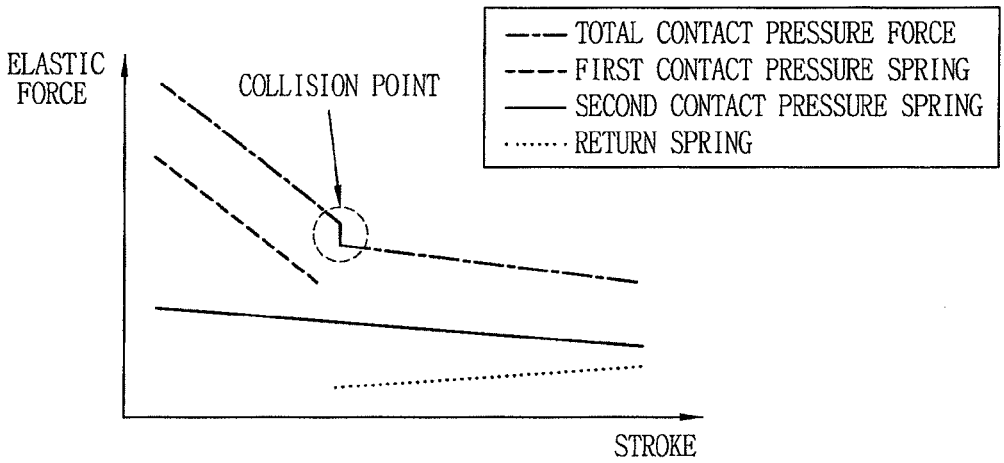
FIG. 3 is a graph showing a change in an elastic force over a contact position moving stroke of a movable contactor in a sealed cased magnetic switch according to the preferred embodiment of the present invention illustrated in FIG. 2, specifically, showing a change in an elastic force and a total contact pressure of a return spring and first and second contact pressure springs.

FIG. 2 is a vertical sectional view showing the configuration of a sealed cased magnetic switch according to the preferred embodiment of the present invention, and FIG. 3 is a graph showing a change in an elastic force over a contact position moving stroke of a movable contactor in a sealed cased magnetic switch according to the preferred embodiment of the present invention illustrated in FIG. 2, specifically, showing a change in an elastic force and a total contact pressure of a return spring and first and second contact pressure springs.

As shown in FIG. 2, a sealed cased magnetic switch according to an preferred embodiment of the present invention comprises a sealed container 11, a fixed electrode 12, a movable contactor 13, a driving shaft 16, a movable core 17, a fixed core 15, a bobbin 19, a coil, a yoke, and an iron plate 14.

The sealed container 11 is a container having a substantially alphabet "U" shaped vertical section with one side opened. The sealed container 11 is installed such that the open side points upward and serves as an upper outer casing of the sealed cased magnetic switch.

The fixed electrode 12 is penetratingly installed on and air-tightly attached to the side opposite to the open side of the sealed container 11 so as to be supported by the sealed container 11. The fixed electrode 12 has the function of a terminal to which an external electric wire is connected and the function of a fixed electrode which is brought into contact with the movable contactor 13 or separated from the movable contactor 13. A pair of fixed electrodes 12 are provided.

The movable contactor 13 is configured as a movable electrode that can be moved to a position at which it is brought into contact with the fixed electrode 12 and to a position at which it is separated from the fixed electrode 12. In order to be brought into contact with the pair of fixed electrodes 12 or separated therefrom, the movable contactor 13 may be configured as a conductive plate having a sufficient length equivalent to the length obtained by adding the distance between the pair of fixed electrodes 12 and the width of the respective fixed electrodes 12.

The driving shaft 16 supports the movable contactor 13 and is movable along with the movable contactor 13. The driving shaft 16 and the movable contactor 13 may be connected by fixing the position of an upper end portion, of the driving shaft 16, which is press-fit through an opening formed at a central portion of the movable contactor f13 so as to penetratingly extend, by using a release preventing washer 16*a*. A spring support protrusion 16*b* is formed at a position away by a predetermined distance from an upper end portion of the driving shaft 16 such that it extends (or is protruded) to be perpendicular to an axial direction of the driving shaft 16. The spring support protrusion 16*b* supports a lower end of the first contact pressure spring 23 with a spring support washer (no reference numeral given) having a larger diameter than that of the first contact pressure spring 23 interposed therebetween, rather than directly supporting the lower end of the first contact pressure spring 23.

The movable core 17 is installed at a lower end portion of the driving shaft 16. The movable core 17 is coupled to the lower end portion of the driving shaft 16 through press-fitting, screw connection, welding, or the like, so as to be prevented from being released. The movable core 17 is coupled with the driving shaft 16 and movable together. The movable core 17 may be configured as, for example, an iron core.

The fixed core 15 is installed to face the movable core 17. In FIG. 2, the fixed core 15 positioned at an upper side is installed to face the movable core 17 positioned at a lower side. The driving shaft 16 extends penetratingly at the central portion of the fixed core 15.

A return spring 20 is installed around the driving shaft 16 penetrating the central portion of the fixed core 15. An upper end portion of the return spring 20 is supported by an end portion of an inner circumferential surface of the fixed core 15, and a lower end portion of the return spring 20 is supported by an end portion of an inner circumferential surface of the movable core 17. The return spring 20 applies an elastic force to the movable core 17 in a direction in which the movable core 17 is separated from the fixed core 15. Accordingly, when a current flow to the coil 21 is interrupted so the coil 21 is demagnetized, the movable core 17 is returned to the position away by a gap (D) in FIG. 2 from the fixed core 15 owing to the elastic force of the return spring 20.

The bobbin 19 is provided to accommodate the fixed core 15 and the movable core 17 in a hollow thereof. The bobbin may be made of a synthetic resin material having electrical insulation properties.

A cylinder 18 is installed between the movable core 17 and the fixed core 18 and bobbin 18 in order to provide a movement path.

The coil 21 is wound around the bobbin 18. When current flows through the coil 21, the coil 21 is magnetized to form a magnetic path together with the yoke 22 and the iron plate 14 nearby to provide a magnetic force for moving the movable core 17 such that it is brought into contact with the fixed core 15.

The yoke 22 is installed near the coil 21. When current flows through the coil 21, the yoke 22 forms a magnetic path allowing magnetic flux formed at a right is angle with respect to the current of the coil 21 to move.

The iron plate 14 forms the magnetic path together with the yoke 22 and is installed at an upper portion of the bobbin 19. A through hole is formed at a central portion of the iron plate 14, in which the upper end portion of the fixed core 15 is inserted.

With reference to FIG. 2, the sealed cased magnetic switch according to an preferred embodiment of the present invention further comprises a first contact pressure spring 23 and a second contact pressure spring 24.

One end (i.e., upper end in FIG. 2) of the first contact pressure spring 23 is supported by a lower surface of the movable contactor 13, and the first contact pressure spring applies an elastic force to the movable contactor 13 in a direction in which the movable contactor 13 is brought into contact with the fixed electrode 12 in order to provide a contact pressure. The other end (i.e., a lower end in FIG. 2) of the first contact pressure spring 23 is supported by a spring support washer as a spring seat member 25 having a larger diameter than that of the first contact pressure spring 23. The spring support washer as a spring seat member 25 is supported by the spring protrusion 16*b* of the driving shaft 16, thus being prevented from moving in the axial direction.

The second contact pressure spring 24 has a diameter larger than that of the first contact pressure spring 23 and applies an elastic force to the movable contactor 13 in a direction in which the movable contactor 13 is brought into contact with the fixed electrode 12 at an outer position in a radial direction compared with the first contact pressure spring 23. One end (i.e., the upper end in FIG. 2) of second contact pressure spring 24 is supported by the lower surface of the movable contactor 13 and the other end (i.e., the lower end in FIG. 2) of the is second contact pressure spring 24 is supported by the iron plate 14.

Preferably, the first and second contact pressure springs 23 and 24 are configured as coil springs.

The sealed cased magnetic switch according to the preferred embodiment of the present invention configured as described above has the following operation and its effect.

When current for controlling switching is supplied through an extra coil terminal which is not illustrated in FIG. 2 to magnetize the coil 21, the yoke 22 and the iron plate 14 nearby form a magnetic path to allow the moving core 17, overcoming the elastic force of the return spring 20, to move so as to be brought into contact with the fixed core 15.

According to the movement of the movable core 17 to result in contact with the fixed core 15, the movable contact 13 connected to the movable core 17 through the driving shaft 16 is moved to be brought into contact with the fixed electrode 12. Thus, the electric power is supplied from an electrical power source to an electrical load through the sealed cased magnetic switch according to an preferred embodiment of the present invention. At this time, the first and second contact pressure springs 23 and 24 provide a contact pressure to the movable contactor 13 so that the movable contactor 13 can be maintained in the state of being in contact with the fixed electrode 12.

When the supply of the current for controlling switching through an extra coil terminal which is not illustrated in FIG. 2 is stopped, the coil 21 is demagnetized and the magnetic path through the yoke 22 and the iron plate 14 nearby becomes extinct. Accordingly, the movable core 17 is separated from the fixed core 15 due to the elastic force of the return spring 20, to become away by the gap (D) illustrated in FIG. 2 from the fixed core 15.

In this case, according to the downward movement of the movable core 17 so as to be separated from the fixed core 15, the movable contactor 13 connected to the movable core 17 through the driving shaft 16 is also separated from the contact position of the fixed electrode 12 as shown in FIG. 2.

Accordingly, the electric power supply from the electric power source to the electric load through the sealed cased magnetic switch according to the preferred embodiment of the present invention is interrupted.

Because the sealed cased magnetic switch according to the preferred embodiment of the present invention includes the second contact pressure spring 24 having a larger diameter than that of the first contact pressure spring 23 and applies an elastic force to the movable contactor 13 in a direction in which it is brought into contact with the fixed electrode 12 at an outer position in a radial direction compared with the first contact pressure spring 23, the area of the movable contactor 13 to which the first and second contact pressure springs 23 and 24 apply the elastic force increases, so the stress of the movable contactor 13 due to the presence of the first and second contact pressure springs 23 and 24 can be reduced. Also, because the portion of the movable contactor 23 which collides with the fixed electrode 12 is an outer portion corresponding to the outer circumferential portion, not a central portion, of the movable contactor 13, the first and second contact pressure springs 23 and 24, in particular, the diameter of the second contact pressure spring 24, are/is positioned to be close to the outer portion of the movable contactor 13 compared with the related art. Thus, when the movable contactor 13 collides with the fixed electrode 12 at the electric power supplying position, namely, at an ON position, of the sealed cased magnetic is switch according to the preferred embodiment of the present invention, a reaction force applied to the movable contactor 13 by the fixed electrode 12 is mostly absorbed. Thus, as shown in FIG. 3, the interval in which the total contact pressure is nonlinearly stationary by the first and second contact pressure springs 23 and 24 can be shortened, and because an impact is absorbed, noise can be reduced.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A sealed cased magnetic switch, which includes a sealed container with one side opened, a fixed electrode air-tightly attached to the side opposite to the opened side of the sealed container, a movable contactor movable to a position at which it is brought into contact with the fixed electrode and to a position at which it is separated from the fixed electrode, a driving shaft supporting the movable contactor and being movable along with the movable contactor, a movable core coupled with the driving shaft so as to be movable together, a fixed core installed to face the movable core, a bobbin accommodating the fixed core and the movable core in the interior of a hollow thereof, a coil wound around the bobbin, a yoke installed near the coil to form a magnetic path, and an iron plate forming the magnetic path along with the yoke and installed at an upper portion of the bobbin, the sealed cased magnetic switch comprising:

a first contact pressure spring having one end supported by the movable contactor and applying an elastic force to the movable contactor to provide a contact pressure in a direction in which the movable contactor is brought into contact with the fixed electrode;

a spring seat member supporting the other end of the first contact pressure spring and fixedly installed on the driving shaft; and a second contact pressure spring having a diameter larger than that of the first contact pressure spring and applying an elastic force at an outer position in a radial direction compared with the first contact pressure spring to the movable contactor in a direction in which the movable contactor is brought into contact with the fixed electrode, wherein one end of the second contact pressure spring is supported by the movable contactor and the other end of the second contact pressure spring is supported by the iron plate.

2. The magnetic switch of claim 1, wherein the first and second contact pressure springs are configured as coil springs.

* * * * *